US010633807B2

(12) United States Patent
Hirman

(10) Patent No.: US 10,633,807 B2
(45) Date of Patent: Apr. 28, 2020

(54) COLD PLANER CUTTING CHAMBER VENTILATION

(71) Applicant: Caterpillar Paving Products Inc., Brooklyn Park, MN (US)

(72) Inventor: Colton John Hirman, Maple Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 16/009,934

(22) Filed: Jun. 15, 2018

(65) Prior Publication Data

US 2019/0382968 A1 Dec. 19, 2019

(51) Int. Cl.
*E01C 23/088* (2006.01)
*E01C 23/12* (2006.01)
*E21C 35/22* (2006.01)

(52) U.S. Cl.
CPC ..... *E01C 23/088* (2013.01); *E01C 23/127* (2013.01); *E01C 2301/50* (2013.01); *E21C 35/223* (2013.01)

(58) Field of Classification Search
CPC .. E01C 23/088; E01C 23/127; E01C 2301/50; E21C 35/223; B08B 15/02
See application file for complete search history.

(56) References Cited

U.S. PATENT DOCUMENTS 3,743,356 A * 7/1973 Sheets ..... E21C 35/20 299/18
5,938,371 A 8/1999 Gustin
9,873,142 B2 1/2018 Bjorge
2005/0179308 A1* 8/2005 Gaertner ..... E01C 23/088 299/39.2
2011/0278907 A1* 11/2011 Moller ..... E01C 23/088 299/18
2014/0048635 A1* 2/2014 Cutler ..... E02F 3/962 241/191
2015/0104255 A1* 4/2015 Musil ..... E01C 23/088 404/76

(Continued)

FOREIGN PATENT DOCUMENTS

CN 205576705 U 9/2016
CN 205662966 U 10/2016

(Continued)

*Primary Examiner* — Janine M Kreck
*Assistant Examiner* — Michael A Goodwin
(74) *Attorney, Agent, or Firm* — Miller, Matthias & Hull

(57) ABSTRACT

A cold planer and method for ventilating the cold planer. The cold planer comprises a frame, a hood, a milling drum and a ventilation system. The hood is disposed under the frame and defines a cutting chamber. A milling drum is disposed inside the cutting chamber under the hood. The ventilation system comprises a cutting chamber port, a boost fan, a settling box and a main fan. The cutting chamber port extends through the hood. The boost fan is configured to generate a siphon that draws airflow from inside the cutting chamber through the cutting chamber port. The settling box is configured to cause particles to drop out of airflow. The settling box is in fluid communication with the cutting chamber port. The main fan is configured to draw airflow from the settling box and a region in front of the hood and vent it away from the cold planer.

20 Claims, 3 Drawing Sheets

(56) References Cited

U.S. PATENT DOCUMENTS

| | | | | |
|---|---|---|---|---|
| 2016/0326870 | A1* | 11/2016 | Bjorge | E01C 23/088 |
| 2017/0284038 | A1* | 10/2017 | Laux | E01C 23/088 |
| 2017/0350080 | A1 | 12/2017 | Hirman et al. | |

FOREIGN PATENT DOCUMENTS

| | | | |
|---|---|---|---|
| DE | 102005035480 | A1 | 2/2007 |
| EP | 2647770 | B1 | 6/2017 |
| KR | 100910647 | B1 * | 8/2009 |

* cited by examiner

COLD PLANER CUTTING CHAMBER VENTILATION

TECHNICAL FIELD

The present disclosure generally relates to cold planer machines, and more particularly relates to a ventilation system and a method for ventilating a cold planer machine.

BACKGROUND

A machine, such as a cold planer, is typically employed to break up or remove a surface from a paved area. The cold planer, also referred to as a road mill, typically includes a milling system. The milling system includes a milling drum having a plurality of teeth. The milling system draws power from an engine through a suitable interface to rotate the milling drum in a cutting chamber (milling chamber) to perform milling operations on the surface of the paved area. The surface of the paved area breaks apart due to rotation of the milling drum against (and its teeth digging into and tearing apart) the surface. The rotation of the milling drum can also deposit material from the broken up surface on a primary conveyor. The primary conveyor transfers the material to a secondary conveyor, which in-turn can transport the material to a nearby haul vehicle.

During cold planer milling operation, air, fumes, dust and pieces of cut asphalt circulate in the cutting chamber in which the milling drum is operating. Pieces of cut asphalt (large and small pieces) are rapidly and forcefully thrown about in the cutting chamber during the breaking up of the surface. Existing cold planer ventilation systems vent fumes, dust and some smaller particles by using a fan to draw such away from the vicinity of the primary conveyor, and away from the area in front of the cutting chamber. Such ventilation systems draw and transport the fumes, dust and smaller particles to a relatively distant discharge location, for example, the secondary conveyor. The fumes, dust and smaller particles are picked-up outside of the cutting chamber because of the high likelihood of the larger pieces of cut asphalt getting drawn into the fan and causing damage to the fan if the cutting chamber is vented directly.

EP Publication No. 2647770, hereinafter the '770 publication, describes a suction dredger that uses two fans to produce suction. The two fans are arranged in series and are utilized to produce a suction force that moves the dredged material from one location to another location. According to the '770 publication, a goal of the '770 publication is to provide an alternative for handling the variable influence of the suction power of the suction dredger.

SUMMARY OF THE DISCLOSURE

In an aspect of the present disclosure, a cold planer is disclosed. The cold planer comprises a frame; a hood disposed under the frame, the hood defining a cutting chamber; a milling drum disposed inside the cutting chamber under the hood, the milling drum rotatable about an axis; and a ventilation system. The ventilation system comprises: a cutting chamber port extending through the hood; a boost fan configured to generate a siphon that draws airflow from inside the cutting chamber through the cutting chamber port; a settling box configured to cause particles to drop out of airflow, the settling box in fluid communication with the cutting chamber port; and a main fan configured to draw airflow from the settling box and a region in front of the hood and vent it away from the cold planer.

In another aspect of the present disclosure, a method of ventilating a cold planer is disclosed. The cold planer includes a hood defining a cutting chamber, a milling drum disposed inside the cutting chamber, and a ventilation system, the ventilation system including a cutting chamber port extending through the hood, a boost fan configured to generate a siphon that draws airflow from inside the cutting chamber through the cutting chamber port, a settling box configured to cause particles to drop out of airflow, the settling box in fluid communication with the cutting chamber port and the boost fan, and a main fan in fluid communication with the settling box and a region in front of the hood. The method comprising: generating, with the boost fan, a siphon that draws airflow from inside the cutting chamber through the cutting chamber port to the settling box; drawing, with the main fan, airflow from the settling box and from a region in front of the hood toward the main fan; and venting, away from the cold planer, the airflow drawn toward the main fan.

In yet another aspect of the present disclosure, a cold planer is disclosed. The cold planer comprises a frame, a hood, a milling drum and a ventilation system. The hood is disposed under the frame and defines a cutting chamber. The hood partially encloses a milling drum. The milling drum is disposed inside the cutting chamber under the hood. The milling drum is rotatable about an axis. The ventilation system comprises: a cutting chamber port, a boost fan, settling box, and a main fan. The cutting chamber port extends through the hood. The cutting chamber port may be disposed above the milling drum. The boost fan is configured to generate a siphon that draws airflow from inside the cutting chamber through the cutting chamber port. The settling box has a top and a bottom and defines a cavity. The settling box includes a cover disposed at the top of the settling box, and a first sidewall connected to the cover and extending in a downward direction from the cover. The settling box is configured to cause particles to drop out of airflow. The settling box includes a boost fan inlet disposed in the first sidewall, a bottom inlet disposed at bottom of the settling box, and an outlet disposed in the cover. The settling box is in fluid communication with the cutting chamber port and the boost fan through the boost fan inlet. The settling box is in fluid communication with a main fan through the outlet, and is in fluid communication with a region in front of the hood through the bottom inlet. The main fan is configured to draw airflow from the settling box and a region in front of the hood and vent it away from the operator area of the cold planer.

Other features and aspects of this disclosure will be apparent from the following description and the accompanying drawings.

DETAILED DESCRIPTION

Figure 1:
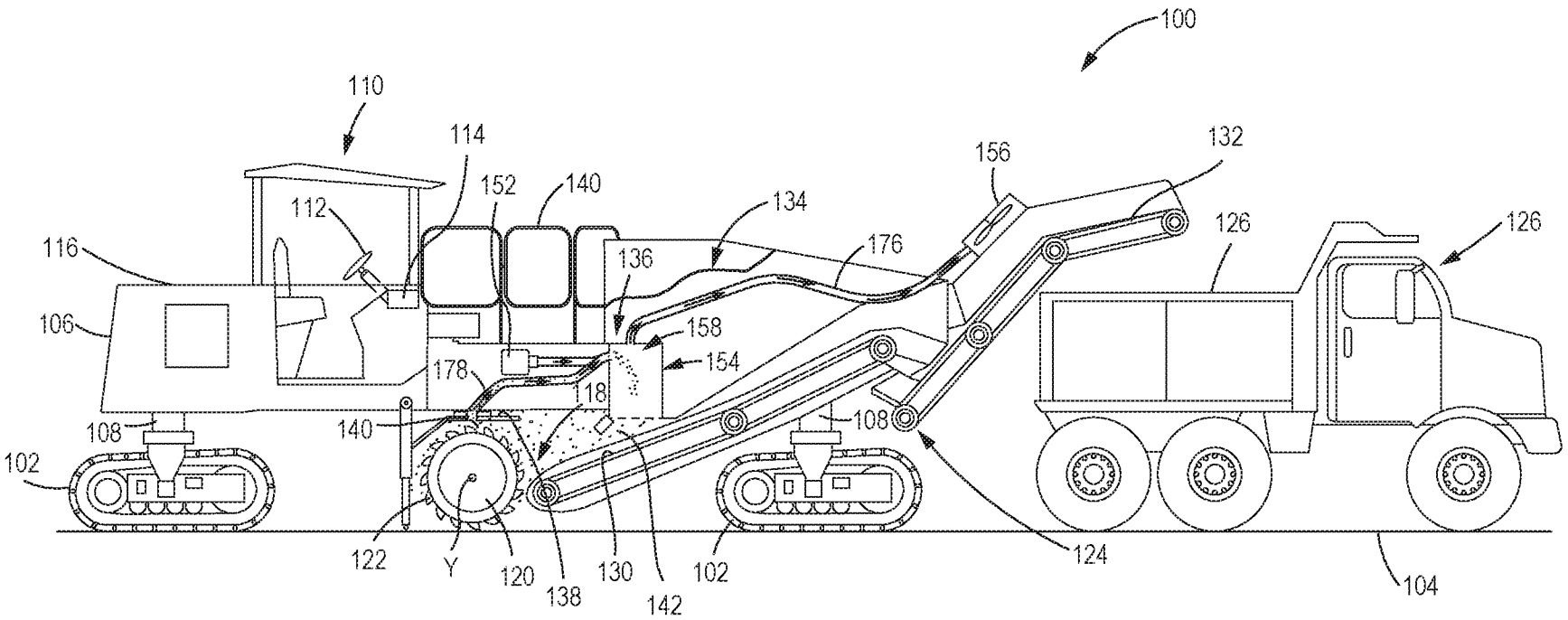
FIG. 1 is a cross-sectional side view of a cold planer, according to one or more embodiments of the present disclosure.

The description set forth below in connection with the appended drawings is intended as a description of various embodiments of the described subject matter and is not necessarily intended to represent the only embodiment(s). In certain instances, the description includes specific details for the purpose of providing an understanding of the described subject matter. However, it will be apparent to those skilled in the art that embodiments may be practiced without these specific details. In some instances, well-known structures and components may be shown in block diagram form in order to avoid obscuring the concepts of the described subject matter. Wherever possible, the same reference numbers will be used throughout the drawings to refer to the same or the like parts.

Any reference in the specification to "one embodiment" or "an embodiment" means that a particular feature, structure, characteristic, operation, or function described in connection with an embodiment is included in at least one embodiment. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments, and it is intended that embodiments of the described subject matter can and do cover modifications and variations of the described embodiments.

It must also be noted that, as used in the specification, appended claims and abstract, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the described subject matter to any particular orientation or configuration. Furthermore, terms such as "first," "second," "third," etc. merely identify one of a number of portions, components, points of reference, operations and/or functions as described herein, and likewise do not necessarily limit embodiments of the described subject matter to any particular configuration or orientation.

Wherever possible, the same reference numbers will be used throughout the drawings to refer to same or like parts. Moreover, references to various elements described herein are made collectively or individually when there may be more than one element of the same type. However, such references are merely exemplary in nature. It may be noted that any reference to elements in the singular is also to be construed to relate to the plural and vice-versa without limiting the scope of the disclosure to the exact number or type of such elements unless set forth explicitly in the appended claims.

As noted above, embodiments of the disclosed subject matter are directed to and involve systems and methods for ventilating a cold planer machine. More particularly, embodiments of the disclosed ventilation system for a cold planer are configured to suction fumes, dust and particles directly from the cutting chamber (e.g., during a milling operation) and output the fumes, dust and smaller particles away from the operator area but exclude particles that are greater than a predetermined size from reaching a main fan (and potentially damaging the fan) and being vented to the atmosphere.

FIG. 1 illustrates a partial cross-sectional side view of an exemplary cold planer 100, according to one or more embodiments of the present disclosure. The "cold planer" may be defined as any machine used to break and remove layers of hardened material from an existing road surface 104. The cold planer 100, also interchangeably referred to as "the cold planer machine 100," or "the machine 100," can include a plurality of ground engaging units 102 for propelling the machine 100 along a road surface 104. The ground engaging units 102 of the machine 100 are connected to a frame 106 of the machine 100 by hydraulic legs 108. Although the ground engaging units 102 of the machine 100 are shown to include tracks, the ground engaging units 102 may alternatively include a set of wheels.

The frame 106 supports an operator area 110 having a steering command element 112 and a controller 114. Although, the steering command element 112 is shown to include a steering wheel in FIG. 1, other steering devices such as a joystick, buttons or levers may be implemented. The steering command element 112 may be in wireless or wired communication with the controller 114 to receive commands. The controller 114 may send control signals based on the commands, to one or more actuators (not shown) of one or more of the ground engaging units 102, and the hydraulic legs 108. In the case of electrically activated actuators, the control signals may act directly on the respective actuators. In the case of hydraulically activated actuators, the control signals may act on valves, which in turn control flow of pressurized fluid to the actuators. The controller 114 may be a separate control unit or may be part of a central control unit operable to control additional functions of the machine 100.

The frame 106 may also support a power source, such as an engine 116. The engine 116 may supply power to the ground engaging units 102 to propel the machine 100 on the road surface 104. In one embodiment, this is accomplished by driving a hydraulic pump (not illustrated) with an output of the engine 116, which in turn supplies high-pressure hydraulic fluid to individual motors (not illustrated) associated with the ground engaging units 102.

The machine 100 also includes a hood 138 disposed under the frame 106. The hood 138 may partially enclose a milling drum 120 and defines a cutting chamber 140.

The machine 100 also includes a milling system 118, supported on the frame 106. The milling system 118 may also receive power from the engine 116. The milling system 118 is configured to mill the road surface 104. The milling system 118 includes the milling drum 120, and a plurality of cutting tools 122 disposed circumferentially around the milling drum 120. The milling drum 120 is rotatable about an axis Y. The milling drum 120 is disposed inside the cutting chamber 140 under the hood 138. A cutting plane of the machine 100 is tangential to the base of the milling system 118 and parallel to the direction of travel of the machine 100. The milling drum 120 of the milling system 118 rotates, upon receiving power from the power source, such as the engine 116, and accordingly, when positioned at the appropriate height for cutting the road surface 104, the plurality of cutting tools 122 come in repeated contact with the road surface 104 to break up a layer of material from the road surface 104. The hydraulic legs 108 may act as elongated telescopic actuators configured to raise and lower the milling system 118 relative to the ground engaging units 102 so as to control a depth of cut by the milling system 118.

A conveyor system 124 is provided on the machine 100 to collect material, such as excavated asphalt produced during breaking up of the road surface 104, by the milling system 118. The conveyor system 124 also transports the collected material to a discharge location, such as a bed 126 of a transport vehicle 128, which may be, for instance, an on-highway haul truck, an off-highway articulated or nonarticulated truck, or any other type of transport vehicle 128 known in the art. Specifically, the conveyor system 124 may include a lower conveyor 130 and an upper conveyor 132 positioned adjacent to the lower conveyor 130. The lower conveyor 130 is configured to collect the material and transport the material to the upper conveyor 132, while the upper conveyor 132 transports the material to the discharge location. In various embodiments, the upper conveyor 132 may be movable relative to the lower conveyor 130 in a vertical direction and/or a horizontal direction so as to adjust the upper conveyor 132 with respect to the discharge location.

The machine 100 may further include a water tank 134. The water tank 134 may be positioned on the frame 106 of the machine 100, proximate to the milling system 118 and the conveyor system 124. The water tank 134 may have box structure with a predefined inner volume defined by a plurality of connected walls connected to a bottom panel and a top panel. The water tank 134 is adapted to hold a predetermined quality of water. The water tank 134 includes at least one water nozzle to selectively dispense the water stored in the water tank 134 toward the milling drum 120 and the plurality of cutting tools 122 of the milling system 118.

The machine 100 further includes a ventilation system 136, supported on the frame 106 of the machine 100. The ventilation system 136, also referred to as "air ventilation system," may, in some embodiments, be integrated with the water tank 134. The ventilation system 136 is configured to provide ventilation or removal of byproducts of the milling operation, such as dust and fumes, to an area away from the operator area 110.

Figure 2:
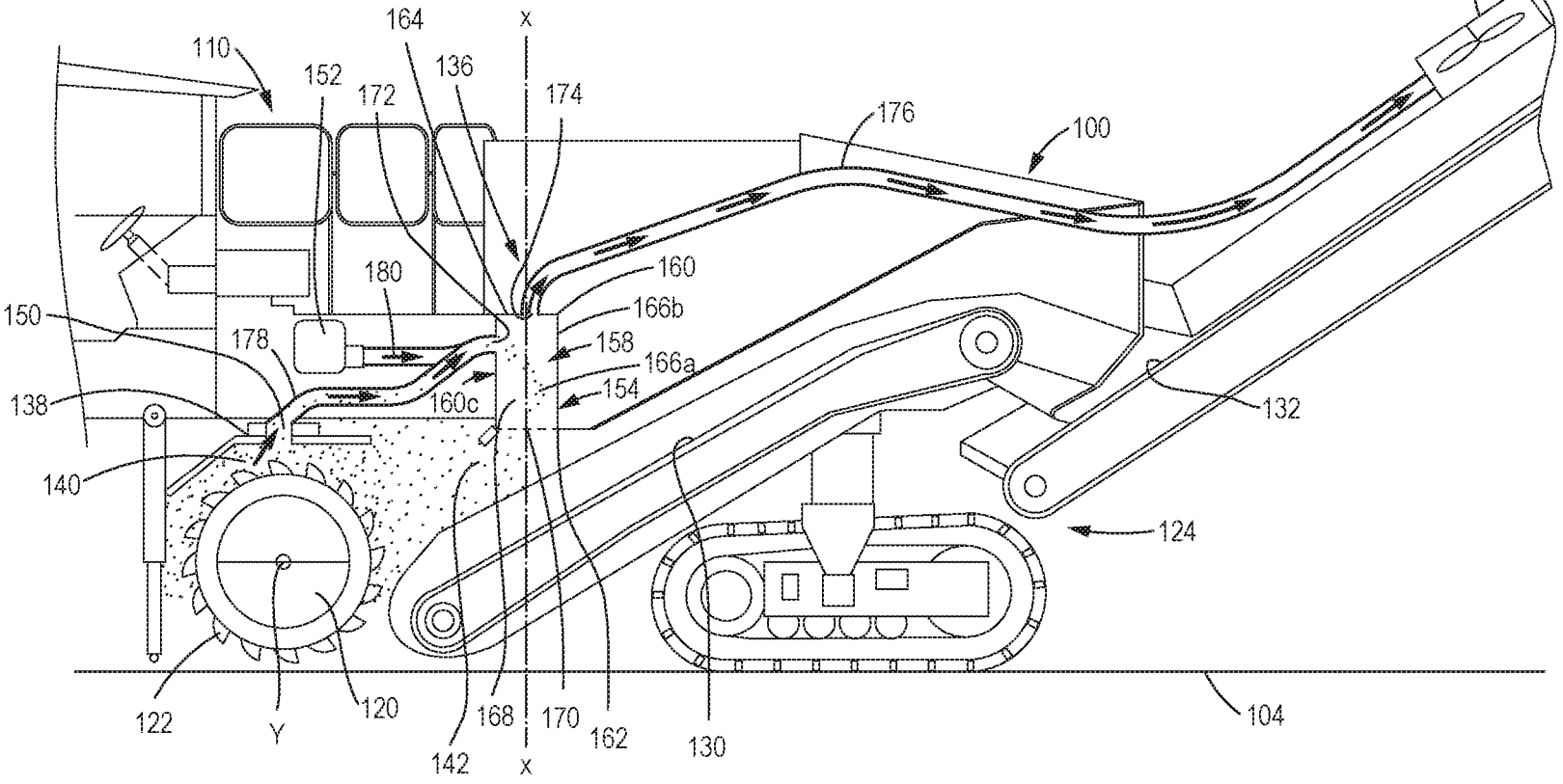
FIG. 2 is a partial cross-sectional view of a portion of the cold planer of FIG. 1.

As illustrated in FIGS. 1-2, the ventilation system 136 includes a cutting chamber port 150, a boost fan 152, a settling box 154 and a main fan 156. The cutting chamber port 150 extends through the hood 138. The cutting chamber port 150 may be disposed above the milling drum 120 and behind a region 142 that is in front of the milling system 118 (including the milling drum 120) and hood 138 (including the cutting chamber 140) and adjacent to a bottom inlet 170 of the settling box 154. In some embodiments, the cutting chamber port 150 may be disposed above the entire milling drum 120. In some embodiments, the cutting chamber port 150 may be centered on the axis Y about which the milling drum 120 rotates. The cutting chamber port 150 may be disposed behind the lower conveyer 130.

The boost fan 152 is disposed on the frame 106 and is configured to generate a siphon that draws airflow from inside the cutting chamber 140 through the cutting chamber port 150 to the boost fan inlet 172 of the setting box 202. The boost fan 152 generates an airflow that flows out of the boost fan 152 in a direction toward the settling box 154 via the boost fan pipe 180

The settling box 154 may also be referred to as "a pickup box" or "pickup member." The settling box 154 is configured to cause particles in the airflow to drop out of the airflow. In an embodiment, the settling box 154 is configured to cause particles to drop out of airflow received from the cutting chamber 140 and airflow received from the bottom inlet 170. In the embodiment shown in FIGS. 1-2, the settling box 154 may be vertically oriented on the frame 106, for instance, along an axis X-X (see FIG. 2). In some embodiments, the settling box 154 may be vertically oriented within the water tank 134 on the frame 106, for instance, along the axis X-X, as shown in FIG. 2. In other embodiments, the settling box 154 may be positioned or oriented differently.

Each settling box 154 includes a body 158 having a top 160 and a bottom 162. The body 158 includes a cover 164 disposed at the top 160 of the body 158. The body 158 further includes one or more sidewalls 166 disposed adjacent to and below the cover 164. Each sidewall 166 may be connected to the cover 164 and extends outward from the cover 164 (for example, extending in a downward direction from the cover 164 toward the road surface 104). For example, the body 158 of the settling box 154 illustrated in FIG. 2, includes a cover 164 and four sidewalls 166(*a-d*) in a rectangular configuration (sidewall 166*d* not visible). In the embodiment of FIG. 2, each sidewall 166(*a-d*) extends from the cover 164 in a downward direction toward the road surface 104. In an embodiment, each sidewall 166 may extend in a "vertically extending" orientation. Herein, "vertically extending" means extending in the vertical direction, plus or minus ten degrees or less from vertical. The body 158 of the settling box 154 may have a rectangular configuration, as shown in FIGS. 1-2, a cylindrical configuration (an example of a settling box 154 that includes one sidewall 166), or may have another configuration, such as, but not limited to, a conical configuration, a frustoconical configuration, a cuboidal configuration, and a spherical configuration. Other geometric shapes may also be provided, such as parallelepiped. Further, the height of the body 158 may be greater that the width of the body 158. The body 158 of the settling box 154 defines an (interior) cavity 168.

The body 158 further includes a bottom inlet 170, a boost fan inlet 172, and an outlet 174. The bottom inlet 170 is disposed at the bottom 162 of the body 158 (or proximal to the bottom 162), opposite from the cover 164. The bottom inlet 170 has a first cross-sectional area (extending across the entrance to the bottom inlet 170). In one embodiment, the cross-sectional area of the bottom inlet 170 may be equal to a cross-sectional area of the body 158. In alternative embodiments, the cross-sectional area of the bottom inlet 170 may be greater than the cross-sectional area of other portions of the body 158. For example, the body 158 may taper inward in an upward direction from the bottom inlet 170.

The bottom inlet 170, (the first cross-sectional area of), may be positioned over a portion of the conveyor system 124 and proximal to a region 142 in front of the milling system 118 (and the hood 138). The bottom inlet 170, or more specifically the first cross-sectional area of the bottom inlet 170, is sized to create a maximum airflow with a minimum surface velocity at the bottom inlet 170 so that only dust, fumes and certain particles (those that have a diameter or cross-section that is less than a predetermined size) generated by operation of the milling drum 120 are drawn into the settling box 154 through the bottom inlet 170 or, alternatively, travel upward through the settling box 154 to reach and pass through the outlet 174 of the settling box 154 (exit the settling box 154 via the outlet 174). The first cross-sectional area may be sized to reject particles which are of a size (e.g., diameter or cross-section) equal to or greater than a predetermined size (also referred to as "a first size"). In one embodiment, the first cross-sectional area of the bottom inlet 170 may be sized to reject particles from the milling drum 120 operation with a diameter 1 millimeter (mm) or greater than 1 mm.

The body 158 of the settling box 154, which may be made from a durable rigid material, such as, but not limited to, metal, metallic alloy, and plastic, is configured to act as a guide channel to allow dust, fumes and particles (of size less than the predetermined size) received through the bottom inlet 170 (at the bottom 162) of the body 158 to flow upwards towards the top 160 of the body 158. The settling box 154 may be configured to stop passage of particles of the predetermined size or greater from reaching a predetermined part of the ventilation system 136, such as outlet 174. The guide channel may be substantially perpendicular to the road surface 104. The body 158 and its (internal) cavity 168 that is the guide channel is configured so that the airflow moves through the settling box 154 upward in a vertical direction or a substantially vertical direction, and particles of the predetermined size or greater will fall with gravity out of the settling box 154 (or to the bottom 162 of the settling box 154).

The dust, fumes and particles (less than a predetermined size) are drawn by the main fan 156 out of the settling box 154 through the outlet 174 (exit the settling box 154 via the outlet 174). In an embodiment, the outlet 174 may be disposed in the cover 164 or in the sidewall 166 and is positioned above the boost fan inlet 172. The outlet 174 may be in a form of a circular opening having a cross-sectional area, referred to herein as a second cross-sectional area (extending across the entrance to the outlet 174). In an embodiment, the second cross-sectional area is less than the first cross-sectional area of the bottom inlet 170.

The settling box 154 further includes boost fan inlet 172. In an embodiment, the boost fan inlet 172 may be disposed in the sidewall 166 and is positioned (elevationally) below the outlet 174. The boost fan inlet 172 may be in a form of a circular opening having a cross-sectional area, referred to herein as a third cross-sectional area (extending across the entrance to the boost fan inlet 172). In an embodiment, the third cross-sectional area is less than the first cross-sectional area of the bottom inlet 170.

An inlet pipe 178 extends between the cutting chamber port 150 and the boost fan inlet 172 of the settling box 154. A boost fan pipe 180 extends between the boost fan 152 and the inlet pipe 178. In an embodiment, the boost fan pipe 180 extends between the boost fan 152 and a portion of the inlet pipe 178 that is proximal to or adjacent to the boost fan inlet 172 of the settling box 154. The settling box 154 is in fluid communication with the cutting chamber 140 via the boost fan inlet 172, the inlet pipe 178 and the cutting chamber port 150. The settling box 154 is in fluid communication with the boost fan 152 via the boost fan inlet 172 and boost fan pipe 180 and inlet pipe 178. In other words, the settling box 154 is in fluid communication with both the boost fan 152 and the cutting chamber 140 through the boost fan inlet 172.

The ventilation system 136 further includes the main fan 156 which is configured to draw airflow from the settling box 154 and from the region 142 in front of the hood 138 (and milling system 118), and to vent it away from the cold planer 100 at a location that is relatively far from the operator area 110 of the cold planer 100. The main fan 156 is in fluid connection with the settling box 154 via the outlet pipe 176 that extends between the outlet 174 of the settling box 154 and the main fan 156. The settling box 154 is also in fluid communication with the region 142 in front of the hood 138 (and the milling system 118) via the bottom inlet 170. The main fan 156 is configured to create a pressure difference at the outlet pipe 176 by drawing air adjacent the bottom inlet 170 into the cavity 168 of the settling box 154. As a result, the main fan 156 is adapted to draw air from below the bottom inlet 170 into the settling box 154, through the outlet 174 and into the outlet pipe 176 by creating airflow through the cavity 168 of a predetermined rate. Thus, in conjunction with the bottom inlet 170, maximum airflow can be created with a minimum surface velocity at the bottom inlet 170. Because the airflow velocity inside the settling box 154 is significantly slower than in the outlet pipe 176, particles equal or greater than a predetermined size, if received into the settling box 154 from the cutting chamber 140 (via the inlet pipe 178), slow down upon entry into the settling box 154, and fall with gravity out of the settling box 154 and do not exit the settling box 154 through the outlet 174.

INDUSTRIAL APPLICABILITY

The disclosed ventilation systems and methods may be used with road material or asphalt removal system, in particular those of a cold planer 100, where control of milling-generated dust and fumes is desired. The cold planer 100 that includes the ventilation system 136 disclosed herein (and the associated method 300 disclosed herein) directly vents (via use of the boost fan 152) from the cutting chamber 140, where dust and fumes tend to be concentrated during milling operation. The ventilation system 136 and method 300 provide improved air quality in the operator area 110, thereby increasing the comfort and well-being of the operator and others that may be in the vicinity of the cutting chamber 140 and areas proximal to the cutting chamber 140 during the milling operation. Furthermore, the additional venting, by the ventilation system 136, of the dust and fumes from the region 142 in front of the milling system 118 and outside of the cutting chamber 140 further improves the air quality and operator environment because fumes and dust that may escape the direct venting from the cutting chamber 140 will also be vented away from the operator area 110. Another advantage to the ventilation system 136 and method 300 disclosed herein is that each provide direct venting from the cutting chamber 140 while avoiding the fan blade damage to the main fan 156 that can occur from chunks of asphalt being ingested by the main fan 156 when attempting to suction fumes and dust directly from inside the cutting chamber 140 during the milling operation. As such, the disclosed ventilation system 136 avoids the costs and machine 100 downtime associated with the fan blade damage described above because, in the ventilation system 136 disclosed herein, chunks of asphalt do not reach the main fan 156.

The disclosed ventilation system 136 draws the dust and fumes directly out of the cutting chamber 140 (as well as from the region 142 proximal to the lower conveyor 130 and in front of the cutting chamber 140, the hood 138 and the milling system 118) and routes such dust and fumes away from the operator area 110 (and thus the operator), while at the preventing relatively large particles (from the milling operation) from reaching the main fan 156.

During operation of the cold planer machine 100, i.e., when the milling system 118 breaks up the layer of material of the road surface 104, dust, fumes, small and larger particles of material can be formed. Rotating movement of the milling drum 120 and the resultant centrifugal force causes the small and large particles of the material to move toward the conveyor system 124.

Simultaneously, the ventilation system 136 pulls dust that is less than a predetermined size and fumes proximal to the bottom inlet 170 into the settling box 154. The orientation of the settling box 154, the height of the body 158 of the settling box 154, the volume of the cavity 168 of the settling box 154, and the first cross-sectional area of the bottom inlet 170 are configured to allow passage into the ventilation system 136 of fumes and particles no larger than the first size and to restrict passage of particles larger than the first size from reaching a predetermined point of the ventilation system 136, for instance, past the bottom inlet 170 (i.e., prevent such particles from entering the ventilation system 136) or downstream of the bottom inlet 170.

Further, operation of the main fan 156 of the ventilation system 136 causes air adjacent the bottom inlet 170 to be pulled into the cavity 168 of the settling box 154 by creating airflow through the cavity 168 of a predetermined rate. The relatively large size of the cross-sectional area of the bottom inlet 170 as compared to the smaller cross-sectional area of the outlet 174 (and outlet pipe 176) results in the surface velocity at the bottom inlet 170 that remains below a predetermined value. Such lower surface velocity and the generally vertical direction of travel of the airflow in the settling box 154 results in particles equal to or larger than the predetermined size, i.e., the first size, being restricted from entry into the settling box 154 and/or gravitationally falling out (or to the bottom of) the settling box 154 and not entering the outlet 174 and outlet pipe 176. As such, in some embodiments disclosed herein, the ventilation system 136 does not include (is free of) screens, filters, vanes, or grates in the settling box 154, over/in the outlet pipe 176, or over/in the bottom inlet 170.

While the above is beneficial, the particles and fumes drawn into the settling box 154 are from the region 142 in front of the milling system 118, for example the milling drum 120, and/or in front of the hood 138 (and the cutting chamber 140), and typically adjacent to the lower conveyor 130. Advantageously, the boost fan 152 of the ventilation system 136 siphons or draws dust and fumes directly out of the cutting chamber 140. The fumes and dust (and particle s less than a predetermined size) are routed away from the operator area 110 (and thus the operator), while at the preventing relatively large particles (those equal to or greater than a predetermined size) from reaching the main fan 156. The boost fan 152 generates an airflow through the boost fan pipe 180 that flows toward the boost fan inlet 172 and into the settling box 154. This flow of air in the boost fan pipe 180 creates a siphon effect in the inlet pipe 178 (the boost fan pipe 180 intersects the inlet pipe 178) and at the cutting chamber port 150 that draws dust and fumes out of the cutting chamber 140 and into the settling box 154 via the inlet pipe 178. Once airflow enters the settling box 154 through the boost fan inlet 172, the velocity of such airflow slows down; any particles drawn into the inlet pipe 178 (along with the dust and fumes) from the cutting chamber 140 drop by the action of gravitational forces out of the settling box 154 through the bottom inlet 170 or, in some embodiments, into the bottom 162 of the settling box 154. The (remaining) fumes and dust in the settling box 154 that entered through the boost fan inlet 172 are then drawn through the outlet 174 (exit out of the settling box 154 via the outlet 174) and along the outlet pipe 176 by the main fan 156 and vented to the atmosphere at a location distal to the operator area 110. In some embodiments disclosed herein, the ventilation system 136 does not include (is free of) screens, filters, vanes, or grates over/in the inlet pipe 178, or over/in the cutting chamber port 150 or boost fan inlet 172.

Figure 3:
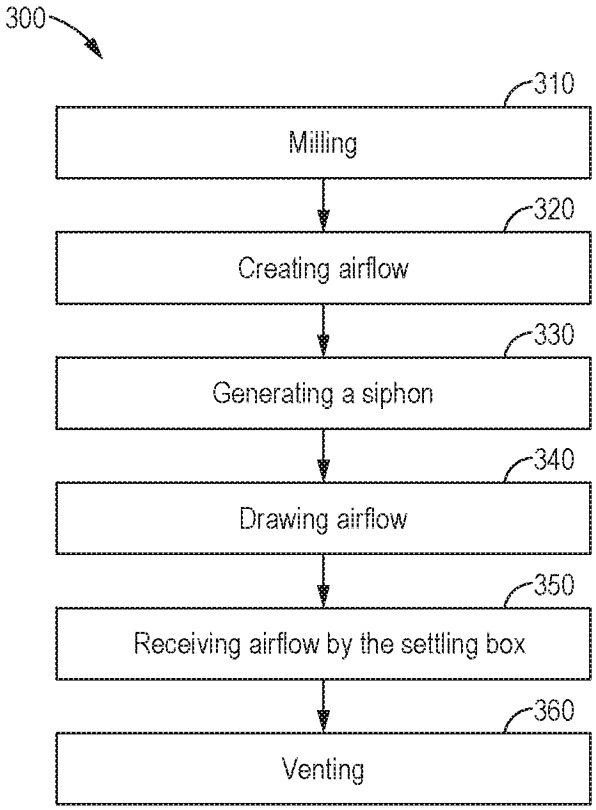
FIG. 3 is a flowchart of a method of ventilating a cold planer.

FIG. 3 illustrates a flowchart of a method 300 of ventilating a cold planer 100, according to one or more embodiments of the present disclosure.

At block 310, the method 300 includes milling a road surface 104.

At block 320, the method 300 includes creating, during the milling operation of the cold planer 100, airflow at or above a predetermined rate to flow through the outlet pipe 176, while maintaining surface velocity at the bottom inlet 170 at below a predetermined value at which fumes and/or particles below a predetermined size pass through the outlet 174 into the outlet pipe 176 and particles at or above the predetermined size do not enter the outlet 174 or outlet pipe 176.

At block 330, the method 300 includes generating, with a boost fan 152, a siphon that draws airflow from inside the cutting chamber 140 through the cutting chamber port 150 to the settling box 154.

At block 340, the method 300 includes drawing, by the main fan 156, airflow from the settling box 154 and from a region 142 in front of the milling drum 120, the hood 138 (including the cutting chamber 140) and the milling system 118 toward the main fan 156.

At block 350, the method 300 includes receiving, by the settling box 154, airflow from the boost fan 152 and from the cutting chamber 140 through a boost fan inlet 172 disposed in a sidewall 166 of the settling box 154.

At block 360, the method 300 includes venting, away from the cold planer 100, the airflow drawn toward the main fan 156.

While aspects of the present disclosure have been particularly shown and described with reference to the embodiments above, it will be understood by those skilled in the art that various additional embodiments may be contemplated by the modification of the disclosed machines, systems and methods without departing from the scope of what is disclosed. Such embodiments should be understood to fall within the scope of the present disclosure as determined based upon the claims and any equivalents thereof.

What is claimed is:

1. A cold planer comprising:

a frame;

a hood disposed under the frame, the hood defining a cutting chamber;

a milling drum disposed inside the cutting chamber under the hood, the milling drum rotatable about an axis; and a ventilation system that comprises:

a cutting chamber port extending through the hood;

a boost fan configured to generate a siphon that draws airflow from inside the cutting chamber through the cutting chamber port;

a settling box in fluid communication with the cutting chamber port to receive the airflow drawn from inside the cutting chamber through the cutting chamber port, wherein the settling box is configured to cause particles having a particle size greater than a predetermined size to drop out of airflow; and a main fan configured to draw airflow from the settling box and a region of the hood in front of the milling drum in the direction of travel of the cold planer and vent the airflow away from the cold planer.

2. The cold planer of claim 1, in which the settling box has a top and a bottom and defines a cavity, the settling box including a cover disposed at the top of the settling box and a first sidewall disposed below the cover, the first sidewall extending from the cover in a downward direction.

3. The cold planer of claim 2, in which the settling box further includes a boost fan inlet disposed in the first sidewall of the settling box, the boost fan inlet in fluid communication with the boost fan and the cutting chamber port to transmit the airflow drawn from inside the cutting chamber to the settling box.

4. The cold planer of claim 3, in which the settling box further includes an outlet disposed above the boost fan inlet, the outlet placing the settling box in fluid communication with the main fan for the main fan to draw the airflow from the settling box and the region of the hood in front of the milling drum.

5. The cold planer of claim 4, in which the settling box further includes a bottom inlet having a first cross-sectional area, the bottom inlet is disposed proximal to the bottom of the settling box and opposite from the cover, the settling box in fluid communication with the region of the hood in front of the milling drum through the bottom inlet.

6. The cold planer of claim 5, wherein the outlet has a second cross-sectional area that is less than the first cross-sectional area of the bottom inlet.

7. The cold planer of claim 1, wherein the cutting chamber port is disposed above the milling drum.

8. A method of ventilating a cold planer, the cold planer including a hood defining a cutting chamber, a milling drum disposed inside the cutting chamber, and a ventilation system, the ventilation system including a cutting chamber port extending through the hood, a boost fan configured to generate a siphon that draws airflow from inside the cutting chamber through the cutting chamber port, a settling box in fluid communication with the cutting chamber port to receive the airflow drawn from inside the cutting chamber through the cutting chamber port, wherein the settling box is configured to cause particles having a particle size greater than a predetermined size to drop out of airflow, and a main fan in fluid communication with the settling box and a region of the hood in front of the milling drum in the direction of travel of the cold planer, the method comprising:

generating, with the boost fan, a siphon that draws airflow from inside the cutting chamber through the cutting chamber port to the settling box;

drawing, with the main fan, airflow from the settling box and from the region of the hood in front of the milling drum in the direction of travel of the cold planer toward the main fan; and venting, away from the cold planer, the airflow drawn toward the main fan.

9. The method of claim 8, further comprising milling a road surface.

10. The method of claim 8, further comprising receiving, by the settling box, airflow from the boost fan and from the cutting chamber through a boost fan inlet disposed in a sidewall of the settling box.

11. The method of claim 10, wherein airflow drawn from the settling box toward the main fan exits the settling box through an outlet disposed in a cover of the settling box.

12. The method of claim 11, wherein the outlet is disposed above the boost fan inlet.

13. The method of claim 8, wherein the cutting chamber port is free of a screen, filter, vane, or grate.

14. The method of claim 8, wherein the settling box is free of a screen, filter, vane, or grate.

15. A cold planer comprising:

a frame;

a hood disposed under the frame, the hood defining a cutting chamber, the hood partially enclosing a milling drum;

the milling drum disposed inside the cutting chamber under the hood, the milling drum rotatable about an axis; and a ventilation system that comprises:

a cutting chamber port extending through the hood, the cutting chamber port disposed above the milling drum;

a boost fan configured to generate a siphon that draws airflow from inside the cutting chamber through the cutting chamber port;

a settling box having a top and a bottom and defining a cavity, the settling box including a cover disposed at the top of the settling box, and a first sidewall connected to the cover and extending in a downward direction from the cover, the settling box including a boost fan inlet disposed in the first sidewall and placing the settling box in fluid communication with the cutting chamber port to receive the airflow drawn from inside the cutting chamber through the cutting chamber port, wherein the settling box is configured to cause particles having a particle size greater than a predetermined size to drop out of airflow, the settling box including a bottom inlet disposed at bottom of the settling box, and an outlet disposed in the cover, and the settling box in fluid communication with a region of the hood in front of the milling drum in the direction of travel of the cold planer through the bottom inlet; and the main fan in fluid communication with the settling box through the outlet and configured to draw airflow from the settling box and the region of the hood in front of the milling drum through the outlet and vent the airflow away from an operator area of the cold planer.

16. The cold planer of claim 15, wherein the cutting chamber port is disposed behind the region of the hood that is in front of the milling drum in the direction opposite the direction of travel of the cold planer.

17. The cold planer of claim 15, wherein airflow from the boost fan and airflow from the cutting chamber are received in the settling box through the boost fan inlet.

18. The cold planer of claim 17, wherein the cutting chamber port is free of a screen, filter, vane, or grate.

19. The cold planer of claim 15, wherein the bottom inlet has a first cross-sectional area, the outlet has a second cross-sectional area that is less than the first cross-sectional area of the bottom inlet, and the boost fan inlet has a third cross-sectional area that is less than the first cross-sectional area of the bottom inlet.

20. The cold planer of claim 15, wherein the settling box is configured to cause particles to drop out of airflow received from the cutting chamber and airflow received from the bottom inlet.

* * * * *